US008923740B2

(12) United States Patent
Kuroda

(10) Patent No.: US 8,923,740 B2
(45) Date of Patent: Dec. 30, 2014

(54) FIXING DEVICE AND IMAGE FORMING APPARATUS

(75) Inventor: Teruaki Kuroda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 234 days.

(21) Appl. No.: 13/456,269

(22) Filed: Apr. 26, 2012

(65) Prior Publication Data

US 2012/0275835 A1 Nov. 1, 2012

(30) Foreign Application Priority Data

Apr. 27, 2011 (JP) ..... 2011-099014

(51) Int. Cl.
*G03G 15/20* (2006.01)

(52) U.S. Cl.
CPC .... *G03G 15/2085* (2013.01); *G03G 2215/2029* (2013.01)
USPC ..... 399/329

(58) Field of Classification Search
CPC ..... G03G 15/2064; G03G 2215/2029
USPC ..... 399/329
See application file for complete search history.

(56) References Cited

U.S. PATENT DOCUMENTS

| | | | | |
|---|---|---|---|---|
| 7,209,697 | B2 * | 4/2007 | Yoshida et al. | 399/329 |
| 2008/0175613 | A1 * | 7/2008 | Fukai et al. | 399/67 |
| 2011/0134201 | A1 * | 6/2011 | Nishiberi et al. | 347/104 |

FOREIGN PATENT DOCUMENTS

| | | | |
|---|---|---|---|
| JP | 2003-228253 | A | 8/2003 |
| JP | 2005-156679 | A | 6/2005 |
| JP | 2005-242111 | A | 9/2005 |
| JP | 2006-293051 | A | 10/2006 |
| JP | 2007-011224 | A | 1/2007 |
| JP | 2010-217209 | A | 9/2010 |

* cited by examiner

*Primary Examiner* — Walter L Lindsay, Jr.
*Assistant Examiner* — Philip Marcus T Fadul
(74) *Attorney, Agent, or Firm* — Panitch Schwarze Belisario & Nadel LLP

(57) ABSTRACT

An invented fixing device for rendering stable the pressure of a pressure pad and for reducing disorder in images conveys a paper on which toner images are formed and fixes the toner image on the paper in application of heat and pressure. The fixing device includes an endless fixing belt heated and rotationally driven, and a tensioning member tensioning the fixing belt. In the fixing belt, arranged are a fixing roller, a pressure pad pressing the fixing belt from the inner periphery surface to the outer periphery surface, and a guide member guiding the fixing belt in a rotation direction in contact with the inner periphery surface of the fixing belt. Nipping portions are formed outside the fixing belt by contacting the fixing roller with the pressure pad via the fixing belt.

17 Claims, 10 Drawing Sheets

FIXING DEVICE AND IMAGE FORMING APPARATUS

CROSS REFERENCE TO RELATED APPLICATION

This application claims priority benefits under 35 USC, section 119 on the basis of Japanese Patent Application No. 2011-099014, the disclosure of which is incorporated herein by reference.

BACKGROUND OF THE INVENTION

1. Field of the Invention

This invention relates to a fixing device in an image forming apparatus serving as, e.g., electrophotographic printer, photocopier, and facsimile machine and to such an image forming apparatus.

2. Description of Related Art

A belt type fixing device in an image forming apparatus such as, e.g., photocopier, printer, and facsimile machine forming monochrome or multicolor images has an endless fixing belt as described in, e.g., Japanese Patent Application Publication No. 2005-242111. The fixing belt is provided inside with a heating roller heating the fixing belt, a fixing roller rotationally driving the fixing belt, a pressure pad serving as a pressure member located on an upstream side of the fixing roller in a rotation direction of the fixing belt for pressing the fixing belt from an inner peripheral surface to an outer peripheral surface. A pressure roller is arranged outside the fixing belt. The pressure roller is disposed at a position facing to the fixing roller and the pressure pad via the fixing belt, thereby applying pressure to the fixing belt in a direction from the outer peripheral surface to the inner peripheral surface. The fixing belt is sandwiched with the fixing roller, the pressure pad, and the pressure roller to form a nipping portion serving as a contact range.

A medium on which toner images are transferred at the fixing device thus formed passes the nipping portion located between the fixing belt heated by means of the heating roller and the pressure roller and is fed, thereby fixing, to the medium, the toner images on the medium with applied heat and pressure.

With the fixing device in a prior art image forming apparatus, however, the pressure of the pressure pad serving as the pressure member becomes unstable during rotation of the fixing belt, thereby raising a problem that post-fixing images tend to be disordered.

SUMMARY OF THE INVENTION

In the first invention, a fixing device includes: a heating member; a conveying member heated by the heating member for conveying a medium; a tensioning member for tensioning the conveying member; a first pressure member disposed as to face the conveying member; a second pressure member disposed as to face the first pressure member via the conveying member; and a restricting member disposed on an upstream side of the second pressure member in a medium conveyance direction.

According to the fixing device of the first invention, because of having the restricting member, affections of the pressure from the conveying member to the second pressure member can be reduced. The pressure of the second pressure member therefore becomes stable, reducing disorders in images.

DETAILED DESCRIPTION OF THE INVENTION

Features for using the invention are made apparent when a description of preferred embodiments is read in reference with the attached drawings. It is to be noted that the drawings are for an illustrative purpose and not for limiting the scope of the invention.

First Embodiment

[Structure of the First Embodiment]

Figure 2:
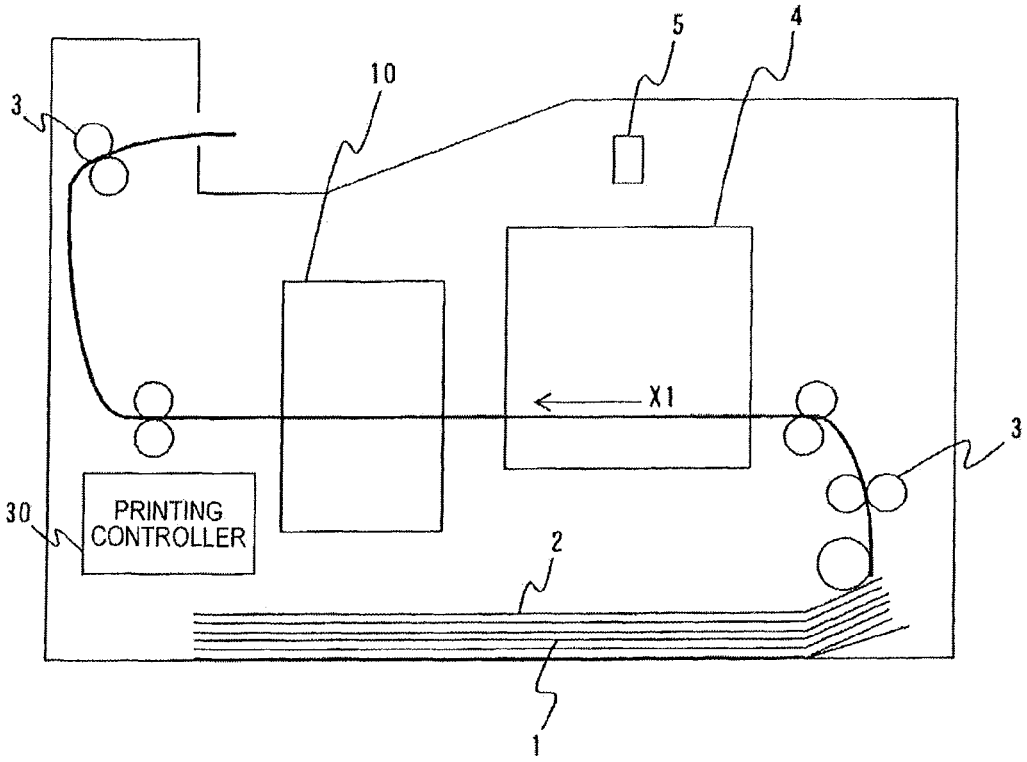
FIG. 2 is a structural view showing an outline of an image forming apparatus according to the first embodiment of the invention.

FIG. 2 is a structural view showing an outline of an image forming apparatus according to the first embodiment of the invention.

This image forming apparatus is, e.g., a printer, and a paper cassette 2 for containing paper 1 as a medium is detachably attached below the apparatus. Plural paper conveying sections 3 made of paper conveying roller pairs for conveying paper 1 are arranged between a paper delivery side of the paper cassette 2 and a downstream side of an upper portion. A toner image forming section 4 serving as a developing device for forming developer (i.e., toner) images and a fixing device 10 located on a downstream side of the section 4 are provided among the plural paper conveying sections 3 in the order of arrow X1 as the paper conveyance direction. A light emitting diode (hereinafter referred to as "LED") head 5 serving as a recording light exposing device is formed adjacently to the toner image forming section 4.

The toner image forming section 4 is a device forming toner images according to the recording light emitted out of the LED head 5 upon transferring the toner images onto the paper 1. The fixing device 10 disposed on the downstream side of the toner image forming section 4 is a device fixing toner images formed on the paper 1 in application of heat and pressure. In the image forming apparatus, a printing controller 30, etc. are provided for controlling an internal mechanism.

Figure 1:
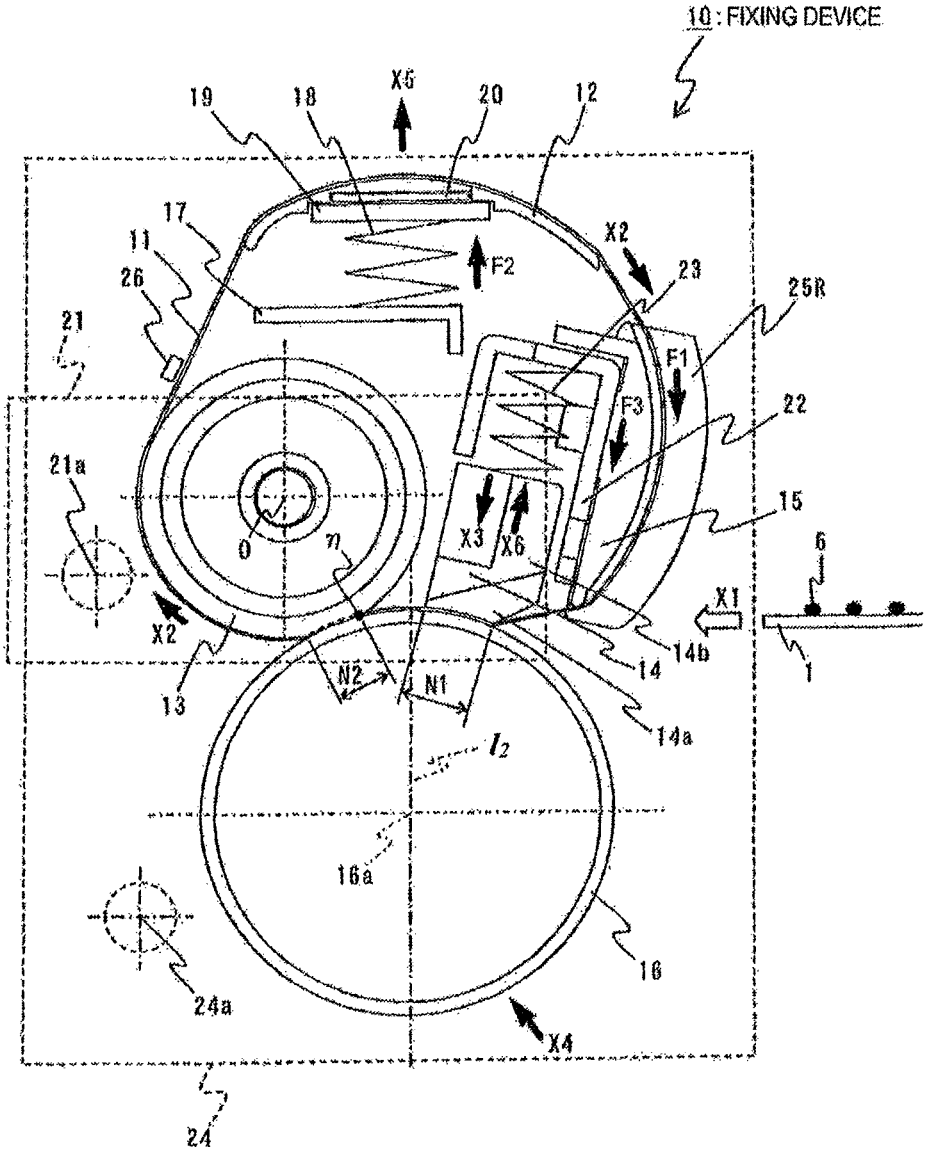
FIG. 1 is a cross section showing a structure of a fixing device in FIG. 2 according to a first embodiment of the invention.
Figure 3:
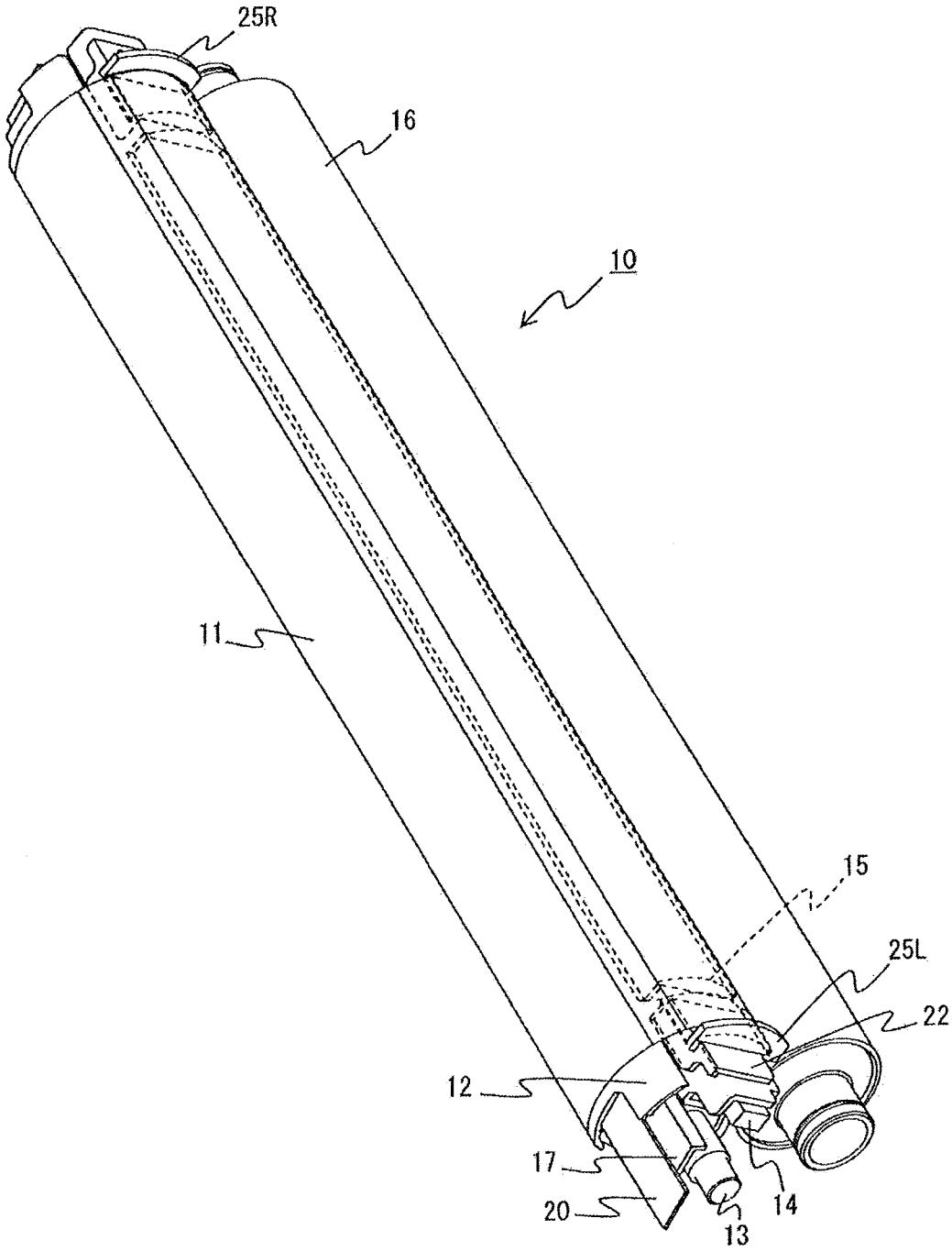
FIG. 3 is a perspective view showing an appearance of the fixing device 10 in FIG. 1.

FIG. 1 is a cross section showing the structure of the fixing device 10 in FIG. 2. FIG. 3 is a perspective view showing an appearance of the fixing device 10 in FIG. 1.

As shown in FIG. 1, the fixing device 10 is a device fixing the toner image 6 on the paper 1 in application of heat and pressure when the paper 1 on which the toner image 6 is formed is conveyed in the paper conveyance direction of the arrow X1, and has a fixing belt 11 made of an endless belt serving as a conveying member supplying heat to the paper 1 and further conveying the paper 1. The fixing belt 11 is for conveying, toward the downstream side in the paper conveyance direction of the arrow X1, the paper conveyed from the upstream side of the fixing device 10 in the paper conveyance direction of the arrow X1.

At an inner peripheral surface as an interior of the fixing belt 11, disposed are a tensioning member 12 for tensioning and heating the fixing belt 11, a fixing roller 13 made of a roller member serving as a fixing member rotationally driving the fixing belt 11, a pressure pad 14 disposed on an upstream side of the fixing roller 13 with respect to a rotation direction of the fixing belt 11 shown as an arrow X2 for serving as a second pressure member pressing the fixing belt 11 from the inner peripheral surface toward a direction of the outer peripheral surface shown as an arrow X3, and a guide member 15 disposed on an upstream side of the pressure pad 14 and on a downstream side of the tensioning member 12 with respect to the rotation direction of the fixing belt 11 shown as the arrow X2 for serving as a restricting member guiding the rotation of the fixing belt 11. The guide member 15 is located on an upstream side of the pressure pad 14 in the paper conveyance direction of the arrow X1. The tensioning member 12, the fixing roller 13, the pressure pad 14, and the guide member 15 are formed wider than the width of the fixing belt 11 in an axial direction of the rotational axis O of the fixing roller 13.

A pressure roller 16 made of a roller member serving as a first pressure member is provided on an outer peripheral surface of the fixing belt 11 as the outside so as to face the fixing roller 13 and the pressure pad 14. The pressure roller 16 forms a first nipping portion N1 as a contact range by pressing the pressure pad 14 via the fixing belt 11 in a direction opposite to the arrow X3, and forms a second nipping portion N2 as a contact range by pressing the fixing roller 13 via the fixing belt 11 in a direction opposite to an arrow X4.

A holder 17 is disposed below the tensioning member 12. The holder 17 is arranged by attaching a holding member 19 via a spring 18 as a first urging member. The spring 18 is a compression spring. The tensioning member 12 is attached on the holding member 19 via a heater 20 serving as a heating member for heating the tensioning member 12. The holding member 19 presses the tensioning member 12 upward as an arrow X5 via the area heater 20 by means of urging force of the spring 18. The fixing belt 11 is heated with the tensioning member 12 holding the area heater 20.

The rotation axis O of the fixing roller 13 is rotationally held to a frame not shown via a bearing or bearings not shown. The pressure pad 14 is held at a lever 21. The pressure pad 14 is urged in a direction of the arrow X3 to pressingly contact the pressure roller 16 around a support 21*a* of the lever 21 as an axis by means of a spring 23 serving as a second urging member supported at the holder 22 held to the frame not shown. The spring 23 is a compression spring. The pressure roller 16 is held rotationally at the lever 24 via a bearing not shown. The pressure roller 16 is urged in a direction of an arrow X4 for pressingly contacting the fixing roller 13 around the support 24*a* of the lever 24 as an axis by an elastic body such as, e.g., a spring not shown, and is in contact with the pressure pad 14 and the fixing roller 13 via the fixing belt 11 at respective positions facing to the pressure pad 14 and the fixing roller 13. A reference number $1_2$ FIGS. 1 and 4 indicate a straight line extending in a direction of the arrow X5 passing through a rotation center 16*a* of the pressure roller 16.

The guide member 15 is secured to the holder 22 held to the frame not shown and partly has an arc shape to make stable the rotation of the fixing belt 11.

As shown in FIG. 3, a pair of flanges 25L, 25R are secured to the holder 22 to restrict move of the opposite ends of the fixing belt 11 in the width direction (i.e., a direction perpendicular to the rotational direction of the fixing belt 11). Each of the flanges 25L, 25R partly has an arc shape inside the fixing belt 11 to make stable the rotation of the opposite ends of the fixing belt 11. Each of the flanges 25L, 25R has, outside the fixing belt 11, a shape larger than the inner radius of the fixing belt 11 to restrict move of the fixing belt 11 in the width direction.

It is to be noted that the flanges 25L, 25R may be secured to the frame not shown to which the holder 22 is held.

As shown in FIG. 1, a temperature detecting means (e.g., temperature sensor) 26 for detecting the temperature of the fixing belt 11 heated by the area heater 20 is arranged near the fixing belt 11. The temperature of the fixing belt 11 is detected by the temperature sensor 26, and is held at a prescribed temperature with the printing controller 30 shown in FIG. 2. The temperature sensor 26 may be a contact type contacting to the outer peripheral surface or the inner peripheral surface of the fixing belt 11, or a non-contact type having a very small gap.

It is to be noted that the pressure roller may have inside a heat source such as, e.g., a halogen heater not shown to accelerate temperature increase of the roller surface.

Respective structural components in the fixing device 10 thus formed are manufactured of the following materials or the like.

In the fixing belt 11, an elastic layer made of a silicone rubber or the like is formed on a base made of a heat resistance resin such as polyimide or a metal such as nickel or stainless steel, and a surface releasing layer using a material excellent in releasing property and heat resistance property, such as, e.g., fluoride based resign at a time pressingly contacting the paper 1 and the toner images 6 is coated on the surface of the elastic layer.

The tensioning member 12 is made of, e.g., a metal having a high thermal conductivity and a high fabrication capability such as, e.g., aluminum and copper, an alloy having main compositions of those, a steel having high heat resistance and rigidity, an iron based alloy group, or a stainless steel. A conductive grease, such as, e.g., silicone grease, fluoroether grease may be filled between the tensioning member 12 and the area heater 20 to enhance the thermal conductivity and to provide electrical conductivity. A fluoric resin may be formed on a contact surface of the tensioning member 12 contacting to the fixing device 11 to increase slidability.

The area heater 20 is a heat generator generating heat upon flowing current, has a flat shape, and can be made of such as a ceramic heater, and a stainless steel heater. Used in the area heater 20 are a resistor heat generator made of, such as, e.g., silver in a thin layer as an electric isolation layer on a base body of, e.g., stainless steel (SUS430) via a glass film, electrodes formed of a metal having chemically stable property and low electric resistance such as, e.g., silver or a high melting point metal such as tungsten at ends of the resistor heat generator, and a protection layer formed thereon for protection made of glass or major fluoric resin or resins such as, e.g., PTFE (polytetrafluoroethylene), PFA (perfluoroalkoxy alkane), FEP (fluorinated ethylene propylene copolymer).

The fixing roller 13 and the pressure roller 16 are respectively constituted of a core metal made of such as aluminum or steel, and an elastic body layer made of a fluoric rubber or silicone rubber as well as a surface releasing layer made of a fluoric resin on an outer periphery of the core metal.

The pressure pad 14 is formed of a base material 14*a* of a metal such as, e.g., aluminum and steel, and an elastic body layer made of such as, e.g., fluoric rubber and silicone rubber in a united body with the base material, and a surface layer having low surface friction property using a fluoric material or glass fiber sheet is formed on a surface of the elastic body layer 14*b* facing to the fixing belt 11.

The guide member makes stable the rotation of the fixing belt 11, and is constituted of a high heat resistance resin such as, e.g., PPS (polyphenylenesulfide), PAI (polyamideimide), PI (polyimide), PEEK (polyetheretherketone), and LCP (liquid crystal polymer), or a hybrid material composed of those high heat resistance resins and a material such as ceramic, metal, or glass. It is to be noted that a fluoric resin may be formed on a contact surface of the guide member 15 contacting to the fixing belt 11 to enhance the slidability thereof, or other heat resistance resin having a high grade slidability may be formed on the contact surface of the guide member 15 contacting to the fixing belt 11 to enhance the slidability thereof.

The pair of the flanges 25L, 25R serves for making stable the rotation of the fixing belt 11, restricts the fixing belt 11 from moving in the width direction, and is made of a heat resistance resin such as, e.g., PPS, PAI, PI, and PEEK.

With the fixing device 10 thus formed, the fixing roller 13 is rotationally driven by the paper conveying section 3 shown in FIG. 2 via gears not shown. According to this, the fixing belt 11 is rotationally driven in the direction of the arrow X2 in FIG. 1 where the fixing belt 11 is driven by the fixing roller 13 and where the pressure roller 16 is driven according to the frictional force to the fixing belt 11. The pressure roller 16 may be rotationally driven by the paper conveying section 3. The fixing belt 11 is pulled at the first nipping portion N1 where the fixing roller 13 rotates in the direction of the arrow X2 in FIG. 1. The fixing belt 11 rotates with sliding on the guide member 15 because of being tensioned in the direction of the arrow X5 in FIG. 1 by means of the tensioning member 12.

Figure 4:
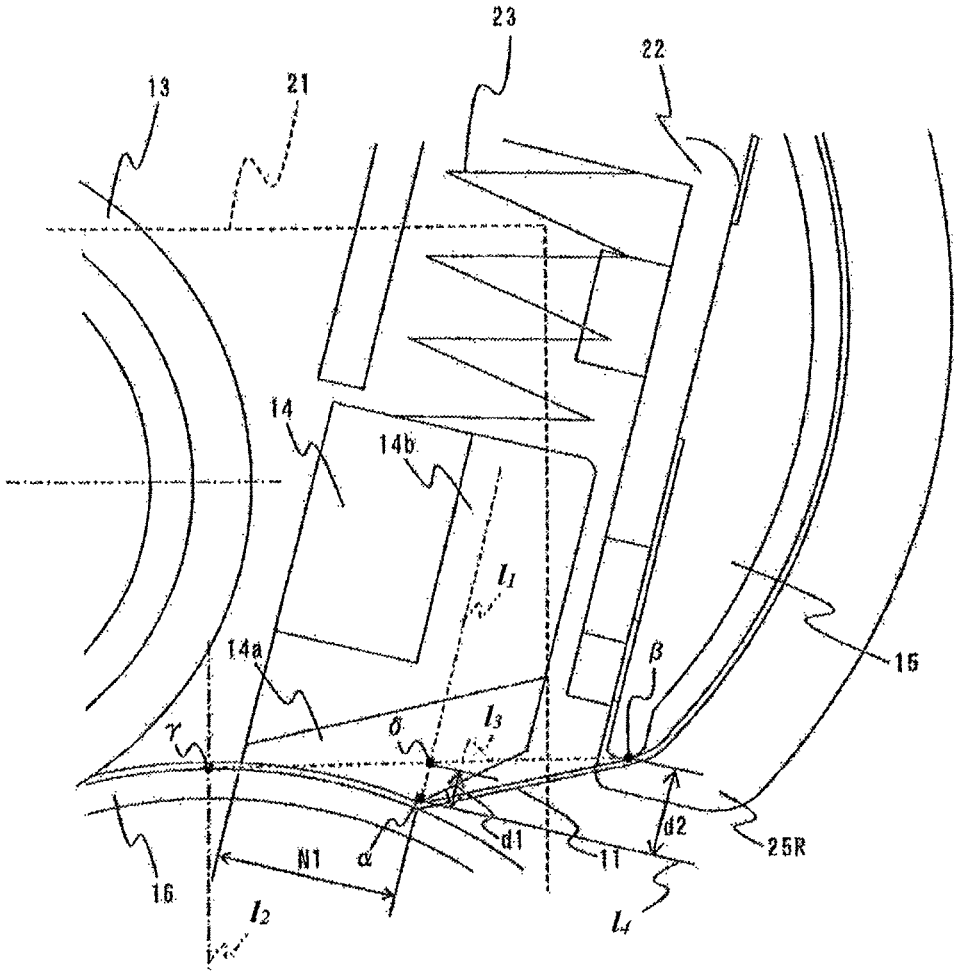
FIG. 4 is an enlarged view showing the vicinity of a pressure pad 14 and the guide member 15 in FIG. 1.
Figure 5:
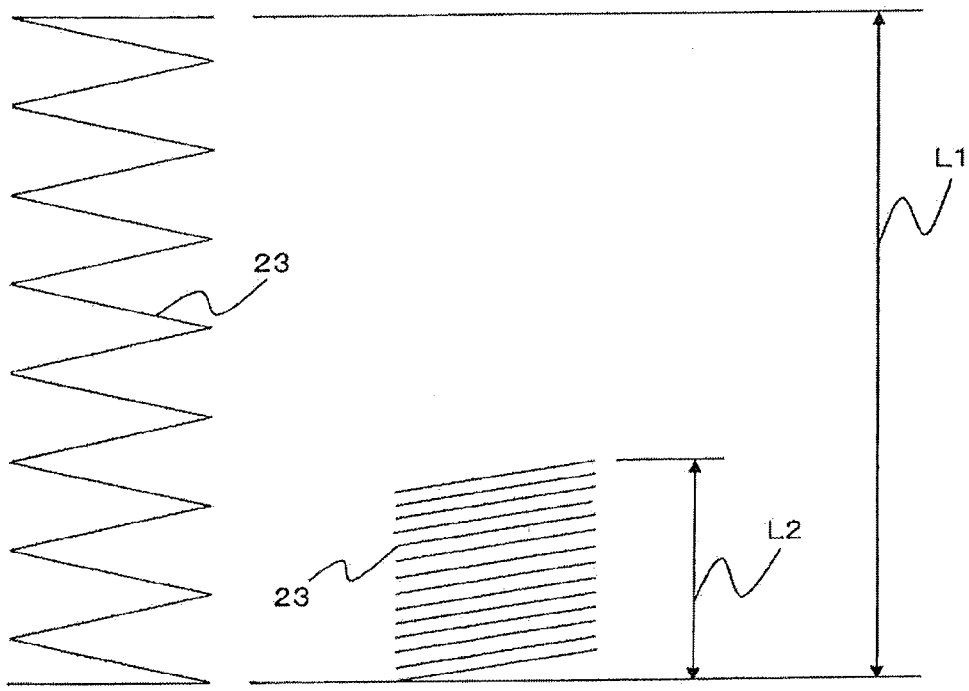
FIG. 5 is an illustration showing a spring 23 in FIG. 4.

FIG. 4 is an enlarged view showing the vicinity of the pressure pad 14 and the guide member 15 in FIG. 1. FIG. 5 is an illustration showing a spring 23 in FIG. 4.

The point α (alpha) in FIG. 4 is a point of the inner peripheral surface of the fixing belt 11 on the pressure pad 14 at a position at which the first nipping portion N1 begins. The point β (beta) is a point on a most downstream side on a side of the pressure pad 14 at which the fixing belt 11 slides on the guide member 15. The point β of the guide member 15 is located at a position at which the fixing belt 11 between the point α and the point β does not contact to the pressure pad 14.

A straight line substantially parallel to an urging direction of the spring 23 shown as the arrow X3 is denoted as $\mathbf{1}_1$. A straight line substantially parallel to an urging direction of the spring 18 shown as the arrow X5 extending from a rotation center 16*a* of the pressure roller 16 is denoted as $\mathbf{1}_2$. The straight line $\mathbf{1}_2$ is extending from the pressure roller 16*a* in a direction substantially perpendicular to the axis of the roller 16*a* in this embodiment. An intersection point of the straight $\mathbf{1}_2$ and the outer peripheral surface of the pressure roller 16 is denoted as a point 65 (gamma); a straight line connecting the point γ with the point β is denoted as $\mathbf{1}_3$. An intersection point of the straight line $\mathbf{1}_1$ and the straight line $\mathbf{1}_3$ is denoted as a point δ (delta); the distance between the point α and the point γ is denoted as d1.

Advantages of this embodiment are surely obtained by setting a formula (L1−L2)>d1 wherein a spring length of the spring 23 at which the pressure pad 14 is forming the nipping portion N1 is denoted as L1 and whereas a spring length in which the spring 23 is in a closely contacting state is denoted as L2, as shown in FIG. 5, because a position η (eta) on the most upstream side in the paper conveyance direction at the nipping portion N2 between the fixing roller 13 and the pressure roller 16 is provided on a downstream side of the rotation center 16*a* of the pressure roller 16 in the paper conveyance direction of the arrow X1.

In FIG. 4, a distance between a straight line $\mathbf{1}_4$ passing through the point α of the nipping portion N1 on the most upstream side in the paper conveyance direction shown as the arrow X1 perpendicular to the straight line $\mathbf{1}_1$ substantially parallel to the urging direction of the spring 23 shown as the arrow X3 and the point β of the guide member 15 is denoted as d2.

Advantages of this embodiment are surely obtained by setting a formula (L1−L2)>d2 wherein the spring length of the spring 23 at a time that the pressure pad 14 is forming the nipping portion N1 and wherein the spring length in which the spring 23 is in a closely contacting state is denoted as L2, as shown in FIG. 5.

In this embodiment, where the fixing belt 11 is conveyed in the direction of the arrow X2 by driving the fixing roller 13, where force pulling the fixing belt 11 in the direction of the arrow X2 is denoted as F1, where urging force of the spring 18 is denoted as F2, and where urging force of the spring 23 is denoted as F3, the force F1 exerts in a direction opposing to the force F2, so that the fixing belt 11 can be tensioned with much less deviations by the tensioning member 12 where the force F2 is set more than the force F1 (F2>F1). To reduce deviations of the nipping portion N1, it is favorable to set a relationship of F3>F4=F2−F1 because the force F3 is favorably set larger than the force exerting in a direction opposite to the urging direction of the force F3. The force F4 (=F2−F1) herein is a component of the urging force of the spring 18 in the urging direction of the spring 23.

Figure 6:
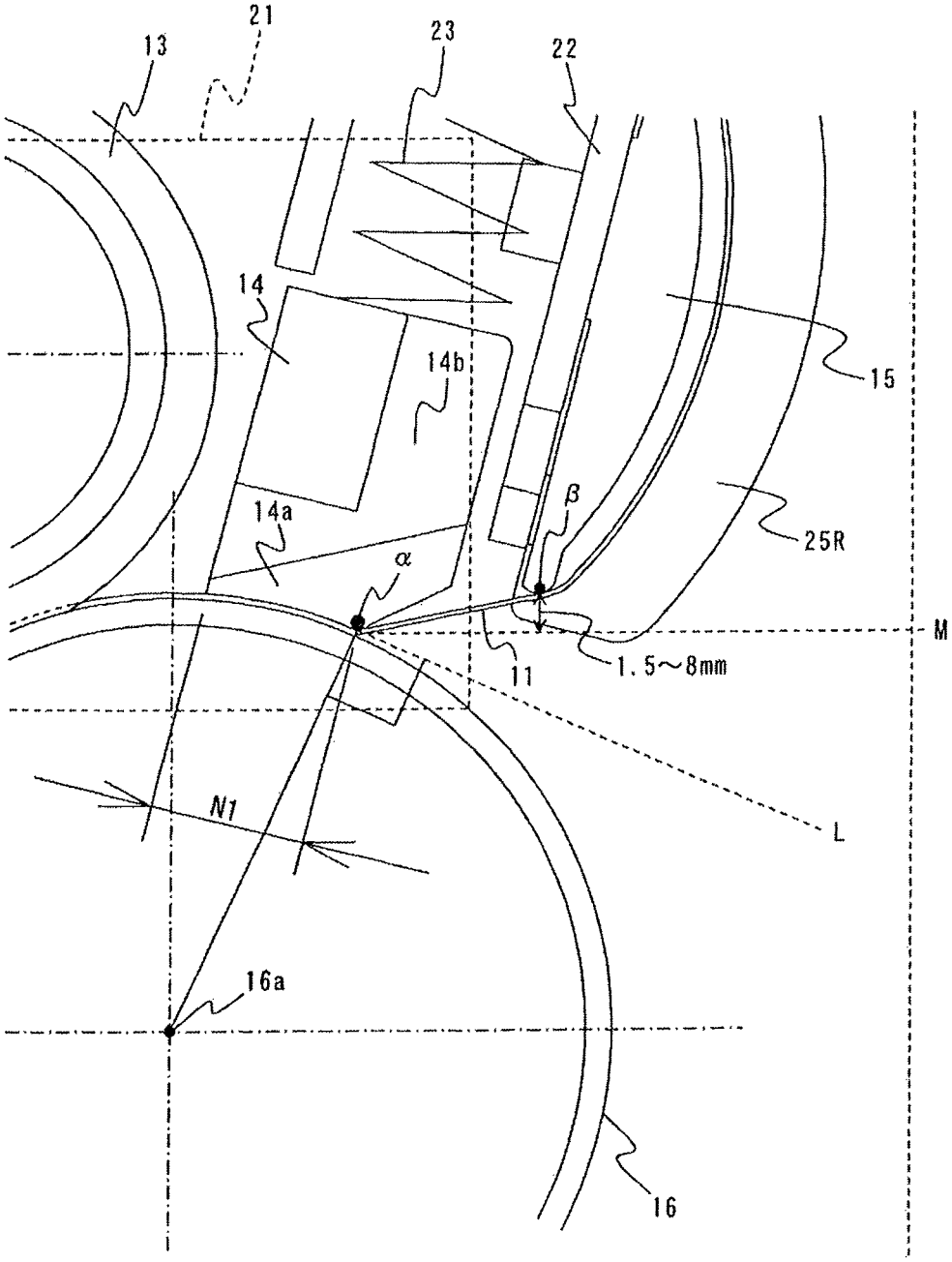
FIG. 6 is an illustration showing positions of α(alpha) and β(beta) in FIG. 4.

FIG. 6 is an illustration showing positions of α and β in FIG. 4. A broken line L in FIG. 6 is a perpendicular line intersecting at the point α on a straight line connecting the rotation center 16*a* of the pressure roller 16 with the point α on an inner peripheral surface of the fixing belt 11 on a side of the pressure pad 14 provided at a beginning point of the first nipping portion N1. A broken line M shows a paper conveyance surface contacting the point α. The point β of the guide member 15 at a position that the fixing belt 11 ends sliding is disposed at a position of, e.g., 1.5 mm through 8 mm above the paper conveyance surface M.

Figure 7:
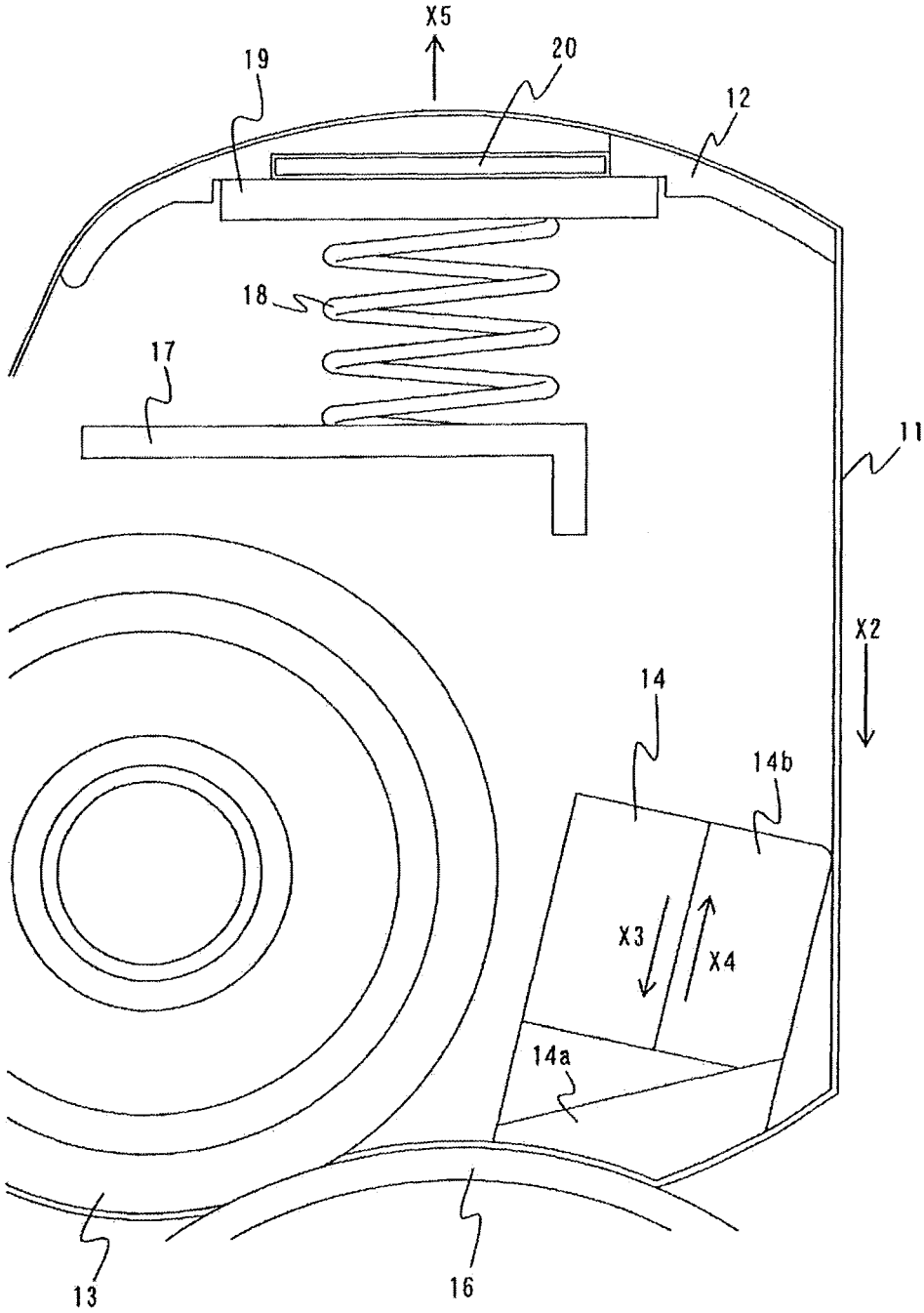
FIG. 7 is a reference view in a case where the guide member 15 does not exist in FIG. 1.

FIG. 7 is a reference view in a case where the guide member 15 does not exist in FIG. 1. In a case where no guide member 15 is provided, a load in a direction of an arrow X4 extending in the opposite direction of the arrow X3 toward which the pressure pad 14 is urged via the fixing belt 11 is increased by the weight load toward the arrow X5 of the tensioning member 12 loaded with the spring 18 tensioned in the direction of the arrow X5, because the fixing belt 11 cannot be restricted on the upstream side of the pressure pad 14, and as a result, the load given in the direction of the arrow X3 by the spring 23 is reduced. That is, the pressure pad 14 affects much more to the load in the direction of the arrow X3 exerted to the pressure roller 16.

[Entire Operation of the Image Forming Apparatus According to the First Embodiment]

In the image forming apparatus as shown in FIG. 2, when the printing controller 30 receives a printing instruction from, e.g., a host device not shown, a paper 1 contained in the paper cassette 2 is fed to the toner image forming section 4 in synchrony with the timing for forming images according to the paper conveying section 3 controlled by the printing controller 30. When the LED head 5 emits recoding light corresponding to printing information to the toner image forming section 4, the toner image forming section 4 produces a toner image 6 in FIG. 6 corresponding to the emitted recording light on the paper 1. When the paper 1 formed with the toner image 6 is conveyed to the fixing device 11 by the paper conveying section 3, the toner image 6 on the paper 1 is fixed with heat and pressure from the fixing device 10. Subsequently, the paper 1 fixed with the toner image 6 is delivered outside by means of the paper conveying section 3.

[Operation of the Fixing Device According to the First Embodiment]

In the fixing device 10 shown in FIG. 1, FIG. 3 through FIG. 6, when the fixing belt 11 is rotationally driven by the fixing roller 13 in the direction of the arrow X2 in FIG. 1 during printing operation, the fixing belt 11 is tensioned with the nipping portion N1 between the pressure pad 14 and the pressure roller 16 and with the tensioning member 12, and rotates slidably on the guide member 15. The tensioning member 12 is heated by the area heater 20 in a heating state upon supply of electric power, thereby heating the fixing belt 11.

A surface temperature of the fixing belt 11 is detected by the temperature sensor 26, and electric power supplied to the area heater 20 is controlled by the printing controller 30 in FIG. 2 based on the detected consequence, thereby maintaining the surface of the fixing belt 11 at a proper temperature. To reduce the affection to the pressure of the first nipping portion N1 from the fixing belt 11, the inner peripheral surface of the fixing belt 11 between the sliding end position (point β in FIG. 4) of the guide member 15 on the fixing belt 11 and the point α on the inner peripheral surface of the fixing belt 11 of the side of the pressure pad 14 as the beginning portion of the first nipping portion N1 is rotating without contacting the pressure pad 14.

The paper 1 formed with the toner image 6 is fed by passing through the nipping portions N1, N2 formed on the fixing belt 11, and the toner image 6 on the paper 1 is fixed onto the paper 1 by application of heat and pressure from the fixing belt 11 and the pressure roller 16.

It is required to make the sliding end position (point β in FIG. 4) of the guide member 15 on the fixing belt 11 theoretically arranged on the perpendicular line L shown in FIG. 6 to render the fixing belt 11 not affect the pressure of the first nipping portion N1 formed with the pressure pad 14 at a time that the fixing belt 11 rotates. If the point β is provided on the perpendicular line L, however, the fixing belt 11 comes close to the paper conveyance surface M, thereby contacting unfixed toner image 6 formed on the paper 1, and disordering the images. To avoid such inconveniences, the location of the sliding end position (point β in FIG. 6) on the fixing belt 11 is arranged at a portion only 1.5 mm through 8 mm above the paper conveyance surface M as separated toward the direction of the tensioning member 12 in the structure of this embodiment.

As shown in FIG. 7, in a case that no guide member 15 is provided, affections of the weight load of the tensioning member 12 tensioned in the direction of the arrow X5 given to the weight load in the direction of the arrow X3 toward which the pressure pad 14 is urged via the fixing belt 11 may become large. To avoid such inconveniences, the guide member 15 is provided in the structure of this embodiment, thereby reducing affections of the fixing belt 11 given to the pressure of the first nipping portion N1 formed with the pressure pad 14 during the rotation of the fixing belt 11 by means of the guide member 15.

[Advantages of the First Embodiment]

According to the first embodiment, because of formation of the guide member 15, affections of the pressure from the fixing belt 11 to the pressure pad 14 can be reduced. The inner peripheral surface of the fixing belt 11 between the sliding end position (point β in FIG. 4) of the guide member 15 on the fixing belt 11 and the point α on the inner peripheral surface of the fixing belt 11 of the side of the pressure pad 14 as the beginning portion of the first nipping portion N1 is made not contacting to the pressure pad 14, so that affections of the pressure at the first nipping portion N1 given from the fixing belt 11 can be reduced. The pressure of the pressure pad 14 is therefore made stable, thereby reducing disorder in images.

Second Embodiment

[Structure of the Second Embodiment]

Figure 8:
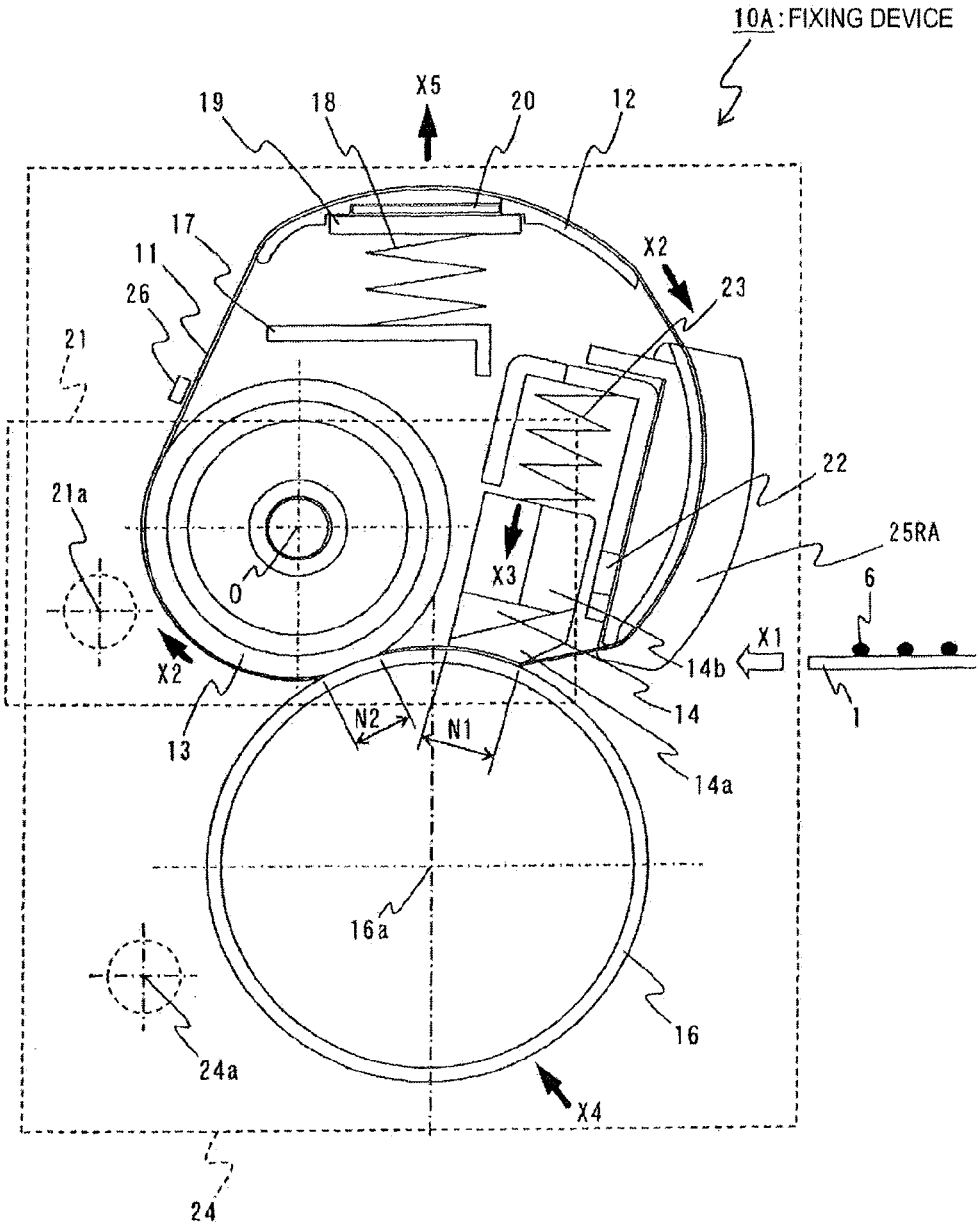
FIG. 8 is a cross section showing a structure of a fixing device according to the second embodiment of the invention.
Figure 9:
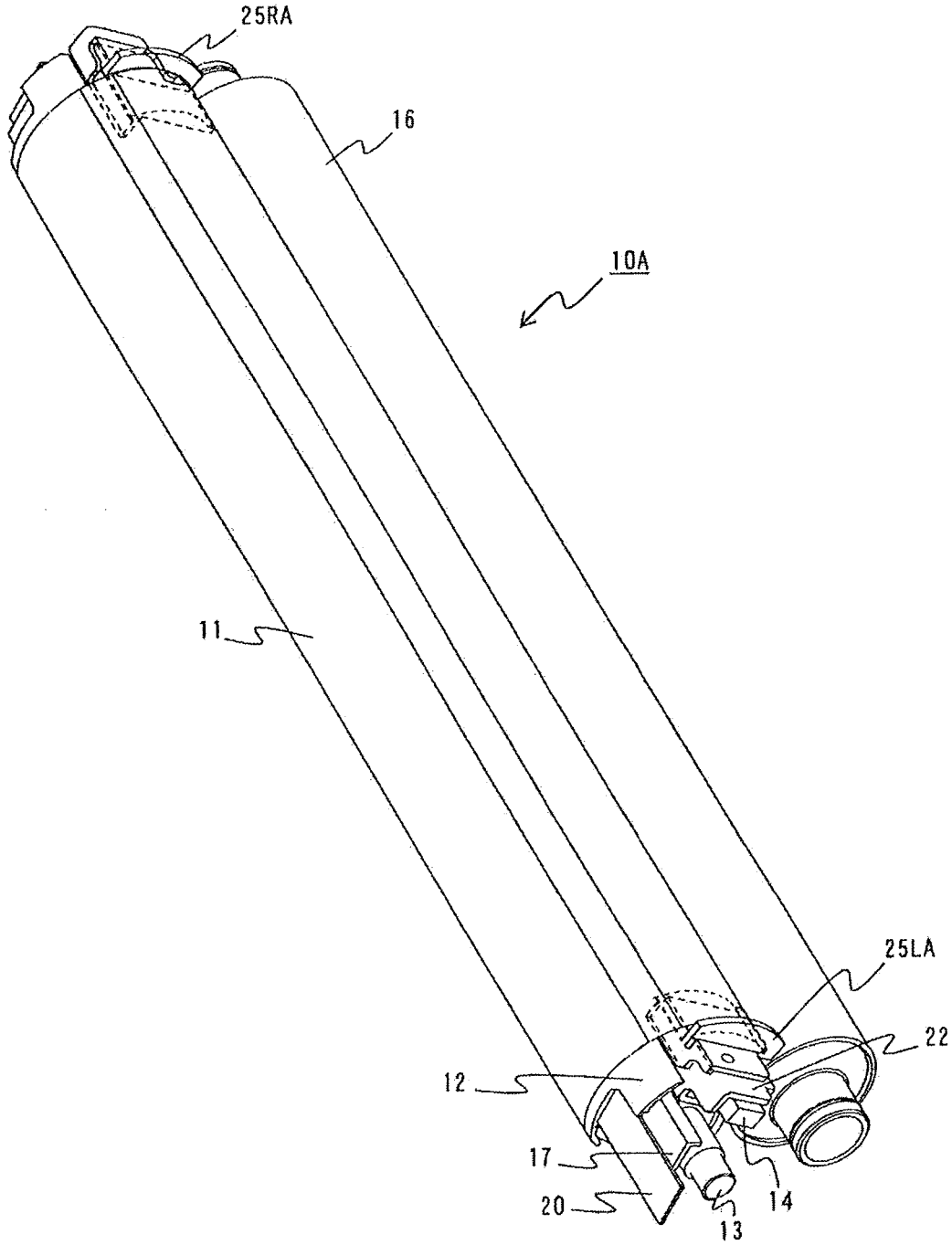
FIG. 9 is a perspective view showing an appearance of the fixing device in FIG. 8.

FIG. 8 is a cross section showing a structure of a fixing device according to the second embodiment of the invention; FIG. 9 is a perspective view showing an appearance of the fixing device in FIG. 8. In FIG. 8 and FIG. 9, common reference numbers are provided to elements common with the elements shown in FIG. 1 and FIG. 3 indicating the first embodiment.

A fixing device 10A according to the second embodiment, in lieu of the fixing device 10 according to the first embodiment, is formed within the image forming apparatus shown in FIG. 2. What is different in the fixing device 10A according to the second embodiment from the fixing device 10 according to the first embodiment is an omission of the guide member 15 in the first embodiment and a formation of a pair of flanges 25LA, 25RA, in lieu of the pair of the flanges 25L, 25R, having structures different from those.

A part of the pair of the flanges 25LA, 25RA is arranged on an inner side of the fixing belt 11, on a downstream side of the tensioning member 12 in the rotation direction of the fixing belt 11 as the arrow X2, and on an upstream side of the pressure pad 14. The pair of the flanges 25LA, 25RA respectively has an arc cross-sectional shape at a portion at an inner side of the fixing belt 11 to render stable the rotation of the opposite ends of the fixing belt 11 in the width direction, and is secured to the holder 22. The portion of the pair of the flanges 25LA, 25RA located on an outside of the fixing belt 11 has a larger shape than an inner diameter of the fixing belt 11 to restrict move of the fixing belt 11 in the width direction. The pair of the flanges 25LA, 25RA may be secured to a frame not shown to which the holder 22 is held. Other structures are substantially the same as those in the first embodiment.

Figure 10:
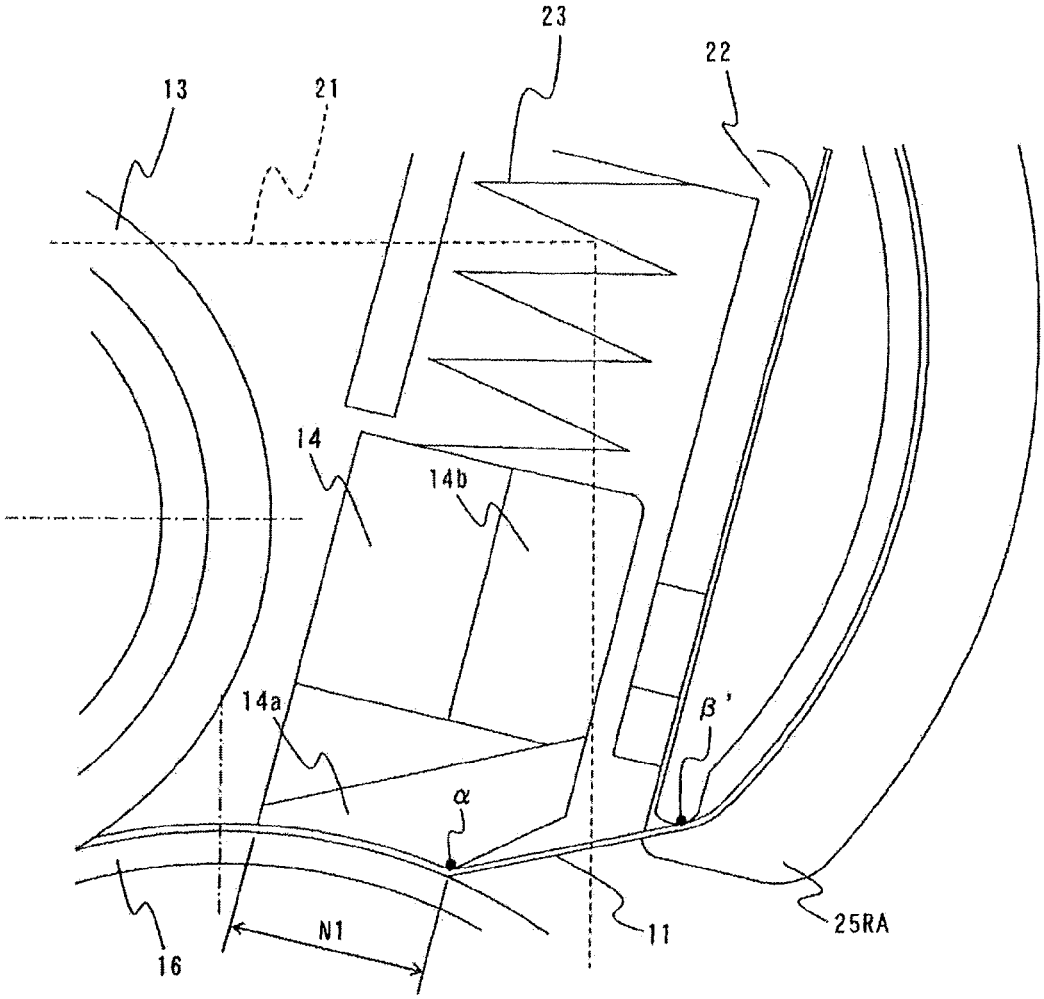
FIG. 10 is an enlarged view showing the vicinity of the pressure pad 14 and a flange 25RA in FIG. 8.

FIG. 10 is an enlarged view showing the vicinity of the pressure pad 14 and a flange 25RA in FIG. 8. The point α in FIG. 10 is, in the same way as in the first embodiment, a point on the pressure pad 14 on an inner peripheral side of the fixing belt 11 at a position that the first nipping portion N1 begins. A point β' is a point positioned on a side of the pressure pad 14 and on the most downstream side of the position that the fixing belt 11 slides on the flange 25RA. The point β' of the flange 25RA is located at a position that the fixing belt 11 does not contact the pressure pad 14 between the point α and the point β'.

In the second embodiment, the structures only on a side of the flange 25A as the one side is described, but those of the flange 25LA on the other side are substantially the same.

[Operation of the Fixing Device in the Second Embodiment]

The operation substantially the same as that of the first embodiment is omitted for the sake of simplicity.

In the fixing device 10A shown in FIG. 8 through FIG. 10, when the fixing belt 11 is rotationally driven in the direction of the arrow X2 in FIG. 7 by the fixing roller 13 during printing operation, the fixing belt 11 is tensioned by the first nipping portion N1 between the pressure pad 14 and the pressure roller 16 and by the tensioning member 12, thereby rotating with sliding on the pair of the flanges 25LA, 25RA. The inner peripheral surface of the fixing belt 11 between the sliding end position (point β' in FIG. 10 in a case of the flange 25RA) of the respective flanges 25LA, 25RA on the fixing belt 11 and the point α on the inner peripheral surface of the fixing belt 11 of the side of the pressure pad 14 as the beginning portion of the first nipping portion N1 is rotating without contacting the pressure pad 14.

The paper 1 on which the toner image 6 is formed is conveyed in passing through the nipping portions N1, N2 formed at the fixing belt 11, and the toner image 6 on the paper 1 is fixed on the paper 1 according to application of heat and pressure by the fixing belt 11 and the pressure roller 16.

With the structure in the second embodiment, the flanges 25LA, 25RA having the different structure from the first embodiment are provided in lieu of the guide member 15 and the flanges 25L, 25R, and the affection of the fixing belt 11 given to the pressure of the nipping portion N1 formed at the pressure pad 14 is reduced by the flanges 25LA, 25RA during the rotation of the fixing belt 11. Sliding portions of the fixing belt 11 in the width direction can be therefore reduced, so that the drive torque for the fixing belt 11 can be reduced.

[Advantages of the Second Embodiment]

According to the second embodiment, because the pair of the flanges 25LA, 25RA is formed, the affection of the pressure from the fixing belt 11 to the pressure pad 14 can be reduced. Because the fixing belt 11 has less sliding portions, the fixing belt 11 can be driven with a torque less than that in the first embodiment. Furthermore, in substantially the same way as in the first embodiment, the inner peripheral surface of the fixing belt 11 between the sliding end position (point β' in FIG. 10) of the respective flanges 25LA, 25RA on the side of the fixing belt 11 and the beginning portion of the first nipping portion N1 on the pressure pad 14 (the point α in FIG. 10) is made in non-contact with the pressure pad 14, so that the affection on the pressure of the first nipping portion N1 received from the fixing belt 11 can be reduced. The pressure of the pressure pad 14 therefore becomes stable, thereby reducing disorder in images.

[Modifications]

This invention is modifiable and applicable to various embodiments not being limited to those in the first or second embodiment. For example, as applications and modification, the following structures (a), (b) are exemplified.

(a) The fixing devices 10, 10*a* can be changed as having a structure other than shown in the drawings. For example, the guide member 15 and the pair of the flanges 25L, 25R can be formed in a united body structure.

(b) The printer as the image forming apparatus according to the first, second embodiments can be changed as having structures other than shown in the drawings. The image forming apparatus of the invention is applicable to such as, e.g., multifunction peripheral (MFP), facsimile machine, and photocopier, as other than printer.

What is claimed is:

1. A fixing device, comprising:

a heating member;

a conveying member heated by the heating member for conveying a medium;

a tensioning member for tensioning the conveying member;

a first pressure member disposed to face the conveying member;

a second pressure member disposed to face the first pressure member via the conveying member;

an urging member for urging the second pressure member with respect to the conveying member; and a guide member, contacting an inner peripheral surface of the conveying member, the guide member being configured to guide the conveying member, wherein an end of the urging member is operably connected to the second pressure member, and an opposite end of the urging member is operably coupled to the guide member.

2. The fixing device according to claim 1, further comprising another urging member for urging the tensioning member in a direction for tensioning the conveying member, wherein the urging member for urging the tensioning member in a direction for tensioning the conveying member is a first urging member and wherein the urging member for urging the second pressure member in a direction toward the first pressure member is a second urging member.

3. The fixing device according to claim 2, wherein the urging direction of the second urging member is opposite to the urging direction of the first urging member.

4. The fixing device according to claim 3, wherein urging force of the second urging member is larger than a component of the urging force of the first urging member provided in a direction that the second urging member urges.

5. The fixing device according to claim 1, further comprising a fixing member disposed on a downstream side of the second pressure member in the medium conveyance direction to face the first pressure member via the conveying member.

6. The fixing device according to claim 5, wherein the fixing member is a roller member.

7. The fixing device according to claim 1, wherein the heating member is held by the tensioning member.

8. The fixing device according to claim 1, wherein the heating member is an area heater; the conveying member is an endless belt; the first pressure member is a roller member; the second pressure member is a pressure pad.

9. The fixing device according to claim 1, wherein the conveying member is positioned, during rotation of the conveying member, between a nipping start position of the second pressure member and a sliding end position of the conveying member on the restricting member is in a non-contact state with the second pressure member.

10. The fixing device according to claim 1, further comprising a flange regulating movement of the conveying member in a width direction thereof.

11. An image forming apparatus comprising:

a fixing device as set forth in claim 1; and a developing device for forming a developer image on the medium and supplying the medium to the fixing device.

12. The fixing device according to claim 1, wherein a holder is connected to the guide member.

13. The fixing device according to claim 1, wherein a connection part of the guide member and the conveying member has an arc shape.

14. A fixing device comprising:

a heating member;

a conveying member heated by the heating member for conveying a medium;

a tensioning member for tensioning the conveying member;

a first pressure member disposed to face the conveying member;

a second pressure member disposed to face the first pressure member via the conveying member;

a restricting member disposed on an upstream side of the second pressure member in a medium conveyance direction;

a first urging member for urging the tensioning member in a direction for tensioning the conveying member; and a second urging member for urging the second pressure member in a direction toward the first pressure member, wherein the urging direction of the second urging member is opposite to the urging direction of the first urging member, wherein the second urging member is a compression spring, and wherein a formula $L1 - L2 > d2$ is set where a length of the compression spring in which a nipping portion is formed between the first pressure member and the second pressure member is denoted as L1 whereas a length of the compression spring in which the compression spring is in a closely contacting state is denoted as L2 and where a distance between a point on the conveying member on the most downstream side in the medium conveyance direction at which the restricting member contacts the conveying member and a point on the conveying member on the most upstream side in the medium conveyance direction at which the conveying member contacts the second pressure member is denoted as d2.

15. The fixing device according to claim 14, wherein one end of the second urging member is operably connected to the second pressure member, and the opposite end of the first urging member is operably connected to the fixed guide member.

16. The fixing according to claim 14, wherein a holder is connected to the guide member.

17. The fixing device according to claim 14, wherein a connection part of the guide member and the conveying member has an arc shape.

* * * * *